US006560986B1

(12) United States Patent
Welch

(10) Patent No.: US 6,560,986 B1
(45) Date of Patent: May 13, 2003

(54) REFRIGERATION VALVE AND SYSTEM

(76) Inventor: Jeffrey K. Welch, 3779 Westover Rd., Orange Park, FL (US) 32003

( * ) Notice: Subject to any disclaimer, the term of this patent is extended or adjusted under 35 U.S.C. 154(b) by 0 days.

(21) Appl. No.: 10/093,063

(22) Filed: Mar. 7, 2002

(51) Int. Cl.[7] ..... F25B 1/00
(52) U.S. Cl. ..... 62/509; 62/498
(58) Field of Search ..... 62/509, 511, 498, 62/512, 210

(56) References Cited

U.S. PATENT DOCUMENTS

| | | | | | |
|---|---|---|---|---|---|
| 4,138,879 | A | * | 2/1979 | Liebermann | 73/19 |
| 4,235,095 | A | * | 11/1980 | Liebermann | 73/19 |
| 4,317,335 | A | * | 3/1982 | Nakagawa et al. | 62/199 |
| 4,523,436 | A | | 6/1985 | Schedel et al. | |
| 4,986,085 | A | | 1/1991 | Tischer | |
| 5,000,009 | A | | 3/1991 | Clanin | |
| 5,011,112 | A | | 4/1991 | Glamm | |
| 5,072,595 | A | * | 12/1991 | Barbier | 62/129 |
| 5,189,885 | A | | 3/1993 | Ni | |
| 5,285,653 | A | | 2/1994 | Meloling et al. | |
| 5,417,083 | A | | 5/1995 | Eber | |
| 5,629,660 | A | | 5/1997 | Kenyon et al. | |
| 5,692,389 | A | | 12/1997 | Lord et al. | |
| 6,449,978 | B2 | * | 9/2002 | Sugisaki et al. | 62/474 |
| 2001/0037658 | A1 | * | 11/2001 | Sugisaki et al. | 62/529 |

OTHER PUBLICATIONS

Damper Actuators—NF24–SR Technical Data—Sep. 29, 2000.

* cited by examiner

*Primary Examiner*—Denise L. Esquivel
*Assistant Examiner*—Marc Norman
(74) *Attorney, Agent, or Firm*—Arthur G. Yeager

(57) ABSTRACT

A vertically oriented refrigerant valve in a refrigeration cycle for substantially reducing vapor bubbles mass in a liquid refrigerant flow and providing a flow modulating and shutoff function. The valve includes an outer shell having a horizontal fluid inlet perpendicular to a vertical axis passing through an inner tubular member positioned inside the outer shell and having a vertical fluid outlet at a distal end, and a condensation chamber formed between the inside surface of the outer shell and the outer surface of the inner tubular member for collecting and condensing rising vapor bubbles from the inlet refrigerant. While the vapor bubbles portion of the refrigerant is collected in the chamber, the liquid passes through a plurality of passageways through the lower portion of the inner tubular member. A slide tube selectively closes and opens one or more of the passageways to control refrigerant flow through the passageways to precisely match the instantaneous needs of the refrigeration system. An actuator will automatically spring return and shut off the valve in the event of a power failure.

32 Claims, 4 Drawing Sheets

FIG. 1

REFRIGERATION VALVE AND SYSTEM

CROSS REFERENCE TO RELATED APPLICATION

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to refrigeration systems and more particularly to refrigeration valves. The present invention is described herein in detail with respect to a conventional industrial refrigeration system. However, those of ordinary skill in the art to which the present invention pertains will readily recognize the broader applicability of the present invention. For example, the present invention may find application in a heat pump system or an air conditioning system or the like.

2. Related Art

Conventional refrigeration systems utilizes a recirculating refrigerant, such as ammonia, for removing heat from the low temperature side of the refrigeration system and for discharging heat at the high temperature side of the refrigeration system. The work input operating the system is provided by a motor driven compressor, which receives low-pressure gaseous refrigerant and compresses it to a high pressure. The high-pressure gaseous refrigerant is supplied to a condenser where heat is removed from the gaseous refrigerant to condense it to a liquid. The liquid refrigerant is then supplied through a control valve to an evaporator wherein heat is transferred from a heat transfer fluid to the liquid refrigerant. The gaseous refrigerant from the evaporator is then returned to the compressor for recirculation through the refrigeration system.

One method of feeding liquid refrigerant to the evaporator coil is known as the "recirculated" method. In this method, the evaporator is literally flooded by recirculating more liquid than the coils can evaporate. Evaporator coils work at optimum efficiency when their entire surface remains wet with liquid refrigerant. During the refrigeration cycle, a portion of the liquid in the evaporator is vaporized into gas. Gas and liquid exit the evaporator and are sent to a gas/liquid separator known as a recirculator. Liquid from the recirculator is sent to the evaporator.

Additionally, a receiver drum can be added between the condenser and the control valve to collect liquid refrigerant and absorb system flow fluctuation. The liquid refrigerant is sent to the control valve to decrease the pressure and temperature of the liquid refrigerant, which is then sent to the recirculator to flood the evaporator.

Conventional means of control consist of a solenoid valve followed by a throttling valve to reduce the pressure and govern the flow rate. There are several drawbacks to conventional means. The refrigerant flow, and hence the load due to flash gas, is intermittent, causing pressure fluctuations, which are detrimental to pump shaft seals and compressor capacity controls. Additionally, the combination of friction losses and ambient heat gain in the high-pressure liquid line preceding the control valve cause vaporization of some portion of the refrigerant producing vapor bubbles. Such vapor bubbles interrupt and reduce the mass flow rate of any throttling valve. Furthermore, the solenoid and throttling valve combination requires the use of numerous fittings and welds.

It is apparent that there is a need for a refrigerant control valve that smoothly modulates the flow of refrigerant, reduces the effect of vapor bubbles and has the capacity to control large systems with a single valve that is both slow closing and tight seating.

Therefore, it is an object of the present invention to provide a refrigeration valve that substantially eliminates vapor bubbles in the liquid refrigerant.

It is another object of the present invention to provide a refrigeration valve which functions as a shutoff valve, with or without a control signal or actuator power.

It is a further object of the present invention to provide a refrigeration valve that includes a condensation chamber for vapor bubbles flowing with liquid refrigerant.

Still another object of the invention is to provide a vertically oriented control valve to provide a chamber for entrained vapor in the liquid refrigerant to be collected and condensed.

Yet is another object of the present invention to provide a vertically oriented refrigeration valve that closes to a tight shutoff upon a loss of power.

It is an additional object of the present invention to smoothly regulate the flow of refrigerant in the system in response to the real time demand.

Other objects include the provision of ceasing fluid flow with one seal prior to fully seating on another seal to reduce wear on the seating seal.

BRIEF SUMMARY OF THE INVENTION

The present invention is directed to a valve for use in a refrigeration system. The valve comprises an elongated housing having a longitudinal axis extending generally vertically and the housing has an inlet that extends generally perpendicular to the axis for receiving a high-pressure liquid refrigerant having traces of entrained vapor bubbles and an outlet for discharging liquid refrigerant and the flashgas generated from the drop in pressure through an outlet directed generally in the same direction as the axis. The housing further includes an upright outer shell having outside and inside surfaces, and an elongated upright inner hollow tubular member positioned inside the outer shell with its longitudinal axis coincident with the axis of the housing. The tubular member has an outer and inner surfaces and proximal and distal ends. The inside surface of the outer shell and the outer surface of the tubular member join to form a vapor bubbles condensation chamber. The chamber includes a collar mounted on the distal end of the tubular member and being affixed to and adjacent the inside surface of the outer shell. The outer shell includes an upper portion and a lower portion. The lower portion has top and bottom end sections wherein the high-pressure liquid refrigerant inlet is generally located medially between the end sections. The upper portion has top and bottom end sections wherein the top end section is part of the vapor bubbles condensation chamber. The tubular inner member has a plurality of vertically spaced passageways extending generally perpendicular to the axis and through the inner and outer surfaces of the tubular inner member. These passageways are located below the bubbles condensation chamber, thus ensuring pure liquid adjacent to the passageways. The tubular member has a long axis substantially coincident with the longitudinal axis. The outlet of the housing is spaced above an outlet of the tubular member and fluidly communicates with each other. The tubular inner member has a slide tube positioned outwardly of the tubular member for selectively closing and opening one or more of the passageways to permit high-pressure liquid refrigerant to pass therethrough in response to the system load requirements and discharge through the outlet. The tubular member includes a ring seal located spacedly above all of the passageways. The slide tube has an upper end portion, which completely closes against the seal to maintain the valve inoperative with the pressurized liquid and vapor refrigerant maintained within the valve housing. The slide tube has distal and proximal ends and includes a lip seal attached to and located adjacent the distal end of the slide tube for sealingly engaging the outer surface of the tubular member during sliding movement of the slide tube in closing and opening one or more of the passageways. The valve further includes a ring disk for sealing between the slide tube and the outer surface of the tubular member.

The valve also includes a movable flow controller means for moving the slide tube. The controller means includes an actuator positioned beneath and to the slide tube for moving the slide tube between open and closed positions. The open position involves exposing one or more of the passageways of the tubular member to permit pressurized liquid to pass therethrough and through the outlet in response to the system load while the closed position blocks flow through the tubular member. The valve is coupled between a receiver of a condenser and a recirculator of an evaporator in a refrigeration cycle.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description, taken in connection with the accompanying drawings, in which:

DETAILED DESCRIPTION OF THE INVENTION

The features and design of the invention are best understood by reference to the attached drawings.

Figure 1:
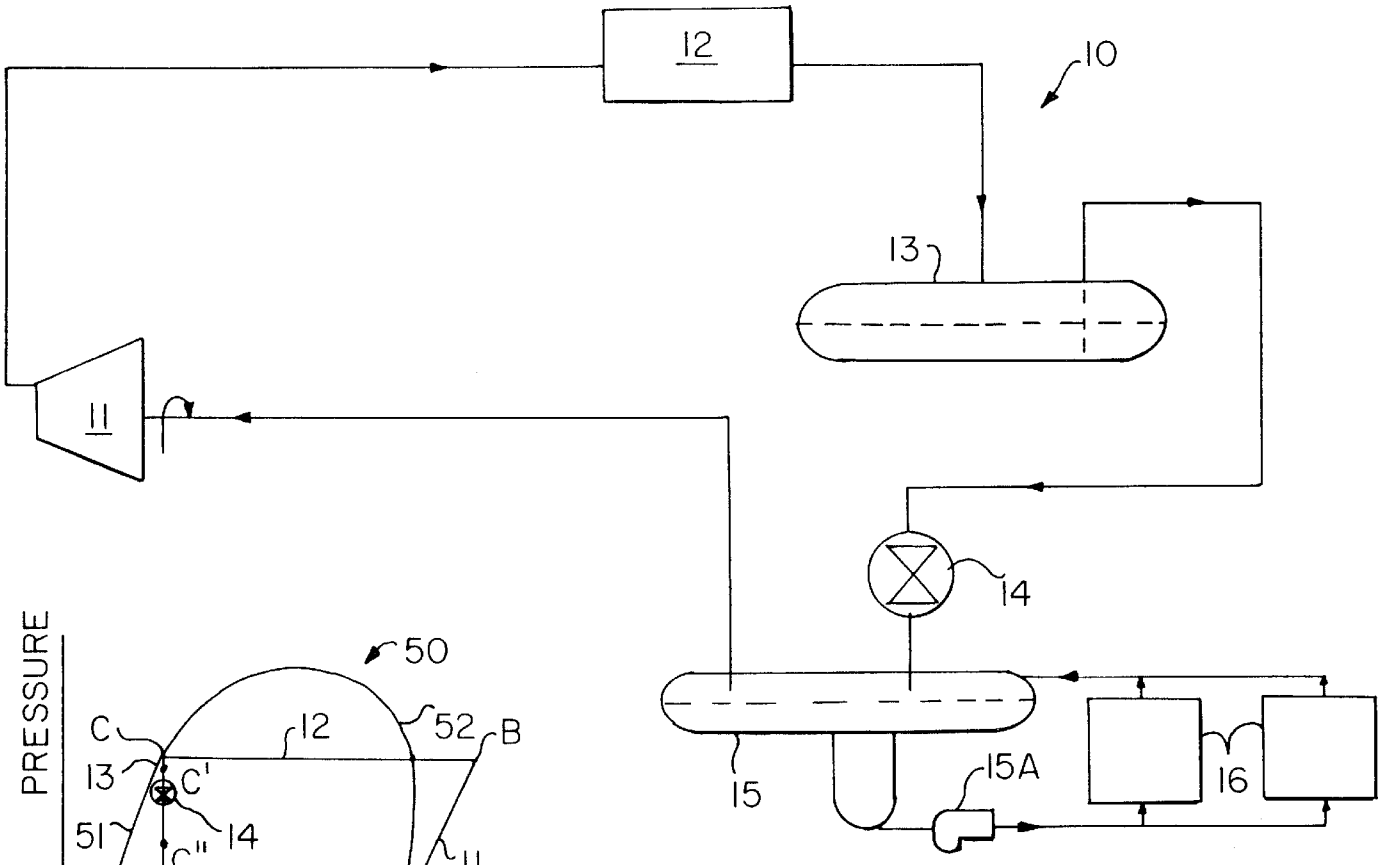
FIG. 1 shows a conventional refrigeration cycle including the refrigeration valve in accord with the present invention.

FIG. 1 shows a refrigeration cycle 10 preferably using an ammonia refrigerant for removing heat from the low temperature side of the refrigeration system and for discharging heat at the high temperature side of the refrigeration system. The cycle begins with the compressor 11 that receives low-pressure gas refrigerant, which is supplied to a condenser 12. The condenser 12 removes heat from the gaseous refrigerant, causing it to condense. This condensed refrigerant drains to the receiver 13, which collects the refrigerant, and functions as a surge vessel for fluctuating flow rates. Liquid refrigerant from the receiver 13 is sent to the control valve 14. In this valve any entrained vapor bubbles are collected and condensed while the flow rate of the liquid refrigerant is regulated and the pressure and temperature are reduced. The liquid refrigerant is then sent to a recirculator 15 that floods evaporators 16 via pump 15A. The recirculator 15 sends more liquid than the evaporator coils can evaporate to force the evaporators 16 to work at optimum efficiency because the evaporators 16 work most efficiently when their entire surface remains wet with liquid refrigerant. A portion of the liquid in the evaporators 15 is vaporized into gas, which is returned to the recirculator 15 along with the excess liquid. The liquid is separated from the vapor in the recirculator 15 and returned back to the evaporators 16. The separated vapor exits the recirculator 15 to the compressor 11 to be compressed, thus completing the cycle.

Figure 2:
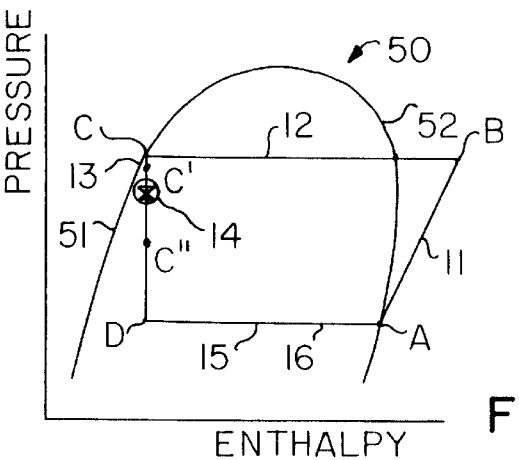
FIG. 2 shows an enthalpy v. pressure graph illustrating enthalpy and pressure change across the refrigeration valve.

The thermodynamic cycle of the refrigeration system will be explained in further detail with reference to FIG. 2, which shows the phase changes in the refrigerant as it moves through the refrigeration cycle. The refrigerant saturation curve 50 is shown in FIG. 2, wherein pressure is plotted against enthalpy. The liquid line 51 is depicted on the left hand side of the saturation curve 50, while the vapor line 52 is depicted on the right hand side of the curve. Initially, slightly superheated vapor enters the compressor 11 from the evaporators 16 via the recirculator 15 at state point A and is compressed to a higher discharge pressure at state point B. The compressed gas enters the condenser 12 where the refrigerant is reduced at constant pressure from a superheated vapor to a liquid at state point C and the heat of condensation is transferred to the coolant passing through or over the condenser heat exchanger tubes. Liquid refrigerant drains to the receiver 13.

Liquid refrigerant having traces of vapor then enters the valve 14 at state point C' and undergoes an expansion at constant enthalpy as it passes through the valve 14 to a lower pressure and temperature at state point C". Liquid and vapor refrigerant is then sent to the recirculator 15 to separate gas from liquid. The separated liquid at state point D is pumped to the evaporators 16. A portion of the liquid is vaporized and returned to the recirculator 15 along with the excess liquid. In the recirculator 15, the vapor is separated, state point A and sent to the compressor 11. The separated liquid state point D, is also pumped to the evaporators 16.

Figure 3:
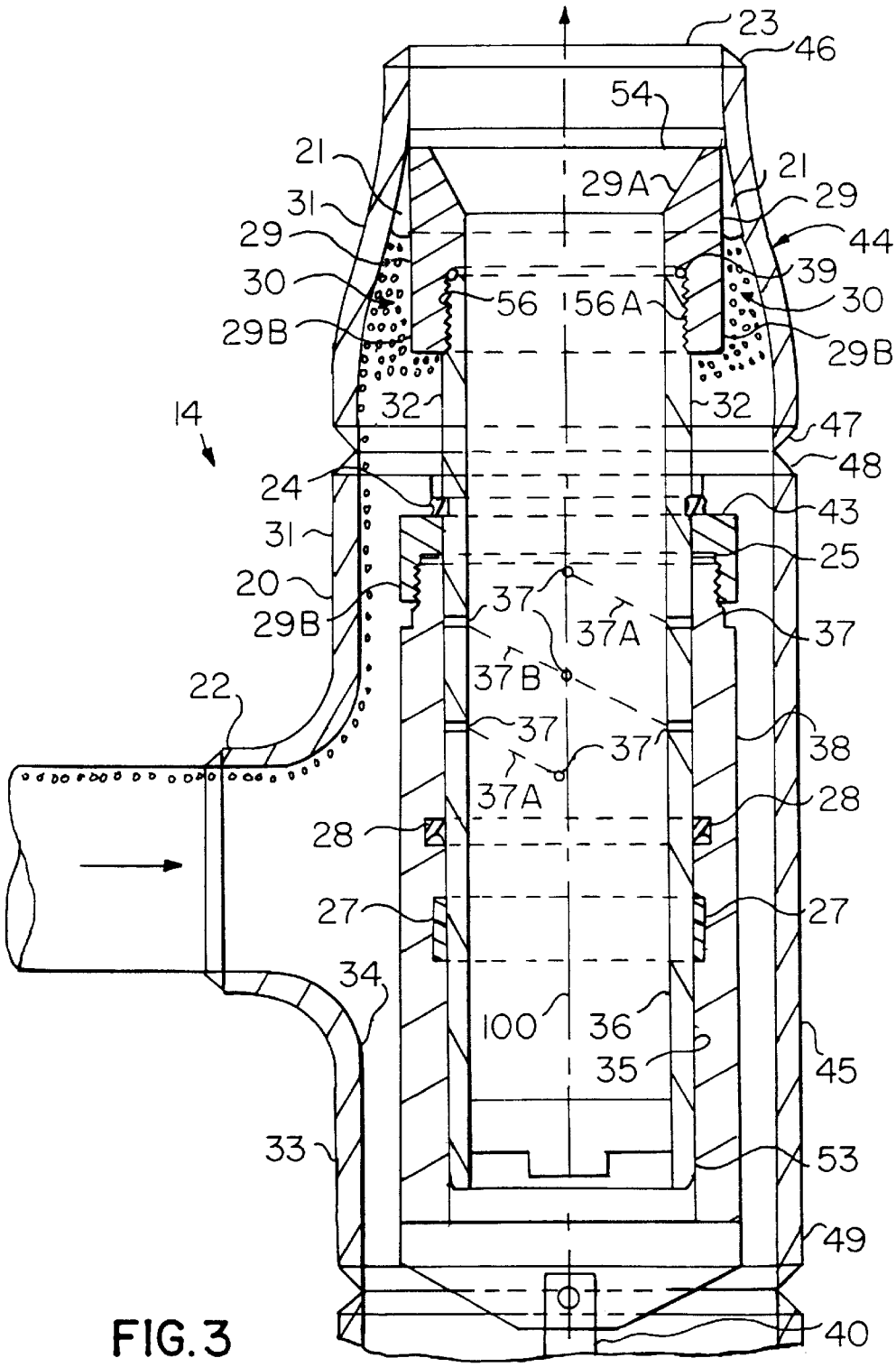
FIG. 3 shows a cross-section of the refrigeration valve.

FIG. 3 shows the refrigeration valve 14 of the present invention. The valve 14 comprises a housing 20 having a longitudinal axis 100 extending generally vertically and includes an outer shell 31 and an inner hollow tubular member 32 inside the outer shell 31. The outer shell 31 is comprised of an upper portion 44 having a top and bottom end sections 46 and 47 and a lower portion 45 having top and bottom end sections 48 and 49, wherein a fluid inlet 22, having a flow temperature of about 75–95° F. and a pressure of about 125–180 psig is located medially between the top and bottom end sections 48 and 49, and a fluid outlet 23 being the top end section 46 of the outer shell 31. The top end section 46 has a diameter $D_1$ that increases toward the bottom end section 47 forming a bottleneck until the bottom end section 47 meets the top end section 48 that has a diameter $D_2$. The lower portion 45 has a uniform diameter $D_2$ from the top end section 48 until the bottom end section 49 except where the inlet 22 meets the outer shell 31.

The inner hollow tubular member 32 is positioned inside the outer shell 31 and has a long axis substantially coincident with the longitudinal axis 100 and includes a proximal end 53 and a distal end 54 where the vapor bubbles condensation chamber 30 is mounted so that vapor bubbles entrained in the refrigerant flow coming through inlet 22 rise to and condense on the cold surface of the vapor bubbles chamber 30. The chamber 30 includes a collar 29 having an upper end 29A mounted on the distal end 54 of the tubular member 32 and being affixed to and adjacent the inside surface 34 of the outer shell 31. The threaded portion 56 of the tubular member 32 is tightened on threaded portion 56A of the collar 29 and seals against flat Teflon® washer 39. The lower end 29B of the collar 29 and the distal end 54 of the tubular member 32 being spaced inwardly from the inside surface of the outer shell 31 to cause rising vapor bubbles to condense thereon, and thereby substantially reduce number and volume of vapor bubbles in the medial area of the housing 31 ensuring a continuous, uninterrupted and smooth pure liquid flow into the passageways 37.

While the vapor bubble portion of the liquid is collected in the chamber 30 and condensed, the liquid passes through the passageways 37 substantially free of vapor bubbles to exit through the outlet 23. The vapor percentage at this point is 10–20% by mass with a temperature of about 10 to 20° F. and a pressure of 25–33 psig. There is a variant of these conditions in a two stage refrigeration system where the high side and low side pressures are in the 25 to 33 psig and 0 psig to 15" Hg vacuum, respectively.

Figure 4:
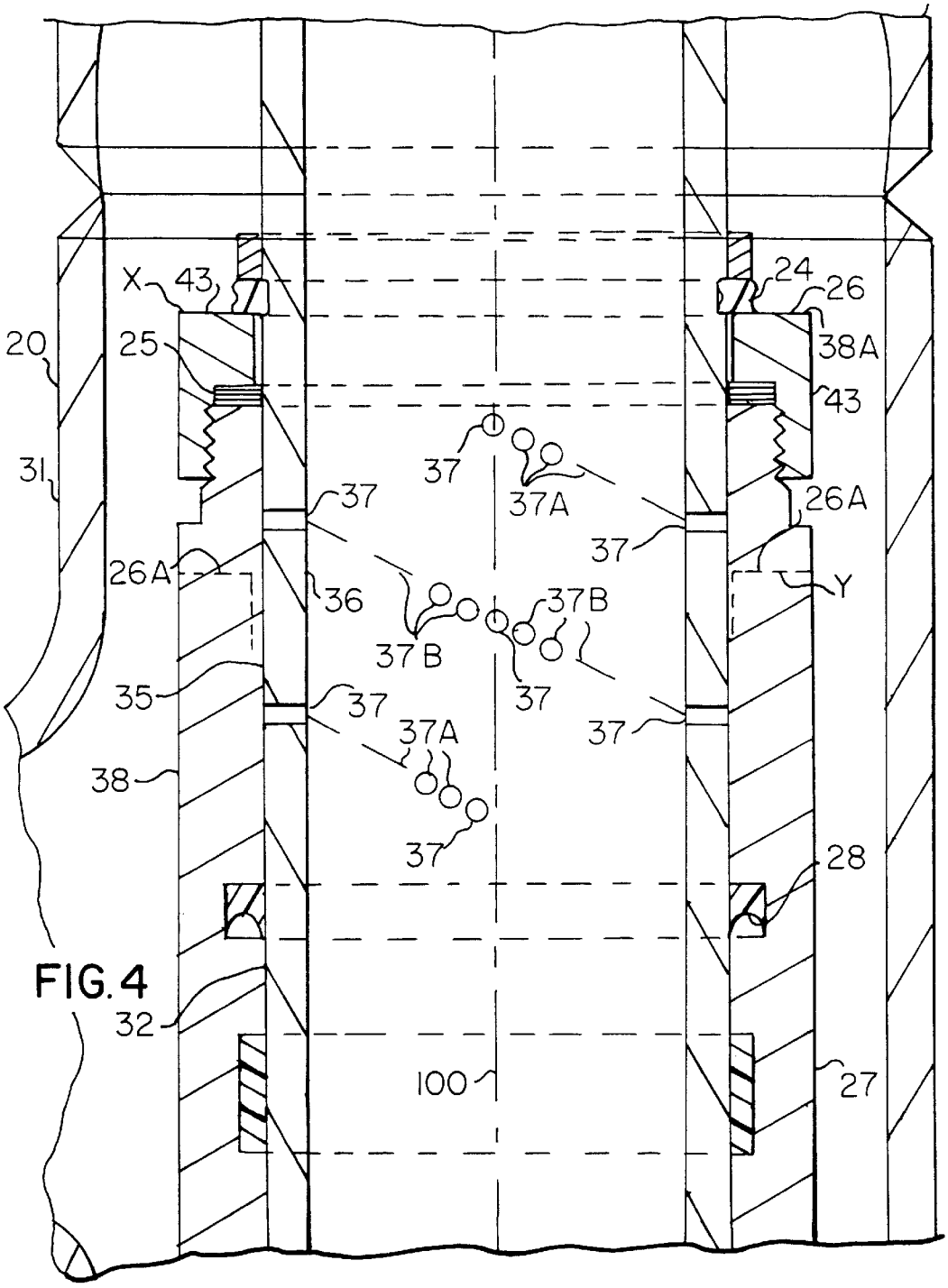
FIG. 4 is a detailed cross-section of the valve illustrating the sliding movement of the slide tube.

FIG. 4 shows the inner tubular member 32 in detail. The inner tubular member 32 has a plurality of vertically spaced passageways 37 extending generally perpendicular to the longitudinal axis 100 extending generally vertically through the inner tubular member 32. The passageways 37 extend through the inner surface 36 and the outer surfaces 35 for permitting liquid refrigerant to pass therethrough. The passageways 37 are below the vapor bubbles condensation chamber 30, ensuring the presence of pure liquid at the entrance of the passageways 37.

The passageways 37 are spaced and extend through the inner surface 36 in a helical path 37A that spirals 360° around member 32. Another helical path 37B spirals for 360° as another set of passageways 37 through the inner surface 36. The passageways 37 may be 3/32 inches and spaced approximately 15 degrees apart on centers. The passageways 37 in member 32 are preferably arranged in a pattern that allows an approximately linear increase in flow rate as the passageways 37 are uncovered by the slide tube 38. The passageways 37 are arranged in a diametrically opposed pattern to reduce the impingement erosion of the inside of the tubular member 32. The size, quantity and arrangement of the passageways 37 may be varied to change the flow coefficient of the valve in response to the capacity required and the refrigerant used in the system.

A slide tube 38 is located outwardly of the tubular member 32 for selectively closing and opening one or more of the passageways 37. The slide tube 38 is movable between a closed position (x), as shown in FIG. 4, and an open position, such as (y), exposing two or more passageways 37 to liquid refrigerant. The slide tube 38 includes nose section 26 at its distal end 38A abutting quad O-ring seal 24 attached to the outer surface 35 of the tubular member 32 to prevent any fluid leakage therefrom. It is to be noted that when the valve is closing, the ring disks 25 seal off the flow of the refrigerant from passing through any passageways 37 prior to being seated on seal 24 so that substantial reduction in wear on seal 24 is achieved.

In the closed position (x), the nose section 26 abuts the quad O-ring seal 24 while in the open position, such as (y), the nose section 26 occupies a new position 26A to expose one or more of the passageways 37 to liquid refrigerant.

The nose section 26 is the upper edge of a collar 43, which is threadedly secured to the slide tube 38 to squeeze a pair of stainless steel ring washers with three Teflon® ring disks 25 so that the disks 25 seal against the inner tubular member 32. The slide tube 38 also includes lip seal 28 to seal against the inner tubular member 32 along with nylon wear bushing 27.

Figure 5:
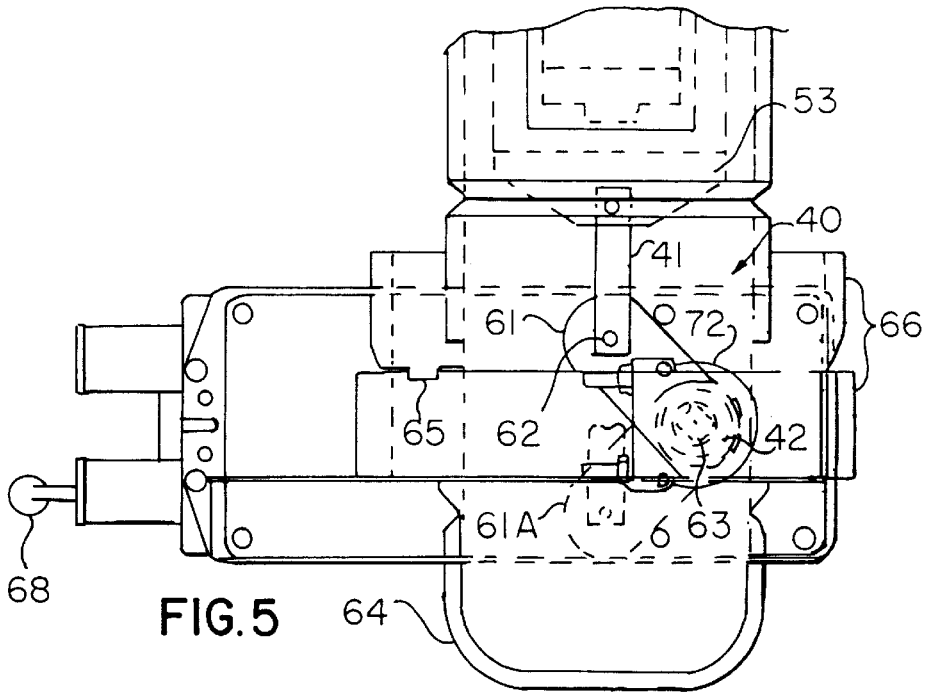
FIG. 5 show the flow controller means or the actuator.

FIG. 5 shows the flow controller means or the actuator 40. The actuator 40 is enclosed by a cap 64. The actuator 40 is pivotally joined to the proximal end 53 of the tubular inner member 32 by an arm 41 that extends into subassembly 66, and is attached to a rocker arm 61 of a shaft 63 by a pivot joint 62. A bushing 42 is mounted around the shaft 63, which is enclosed in a gasket 65. The rocker arm oscillates between its original position, as shown in FIG. 5, and position 61A, shown in dotted lines, when the shaft 63 rotates upon receiving electrical signals through the wires 68. The movement of the rocker arm 61 pushes the slide tube 38 vertically upwardly and downwardly exposing one or more of the passageways 37 to liquid refrigerant flow, to modulate the flow of refrigerant in response to the system load. If the electricity is cut off, the coil spring (not shown) within the actuator 40 turns the shaft 63 which pushes the rocker arm 61 upwardly causing the slide tube 38 to block the passageways 37 preventing liquid flow therethrough, thereby providing a shut off function and eliminating the need for a liquid line solenoid valve. The outer shell 31 is filled with liquid refrigerant at all times, and liquid can seep through the proximal end 53 of the tubular member 32 up to lip seal 28. Actuator 40 may be of the commercially obtained, for example, from Belimo Aircontrols (USA), Inc., proportional control actuator NF24-SR US.

Figure 6:
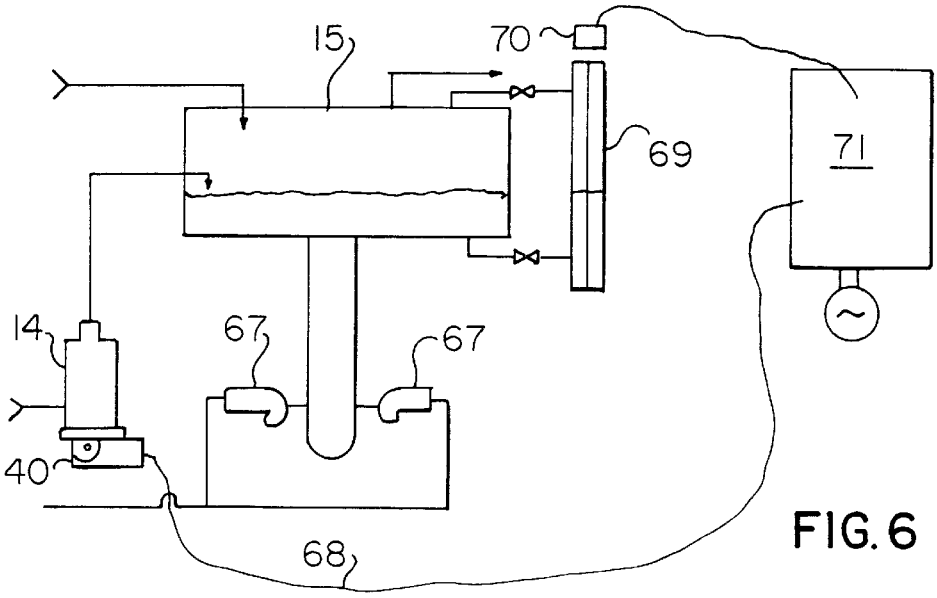
FIG. 6 shows the control mechanism of the valve.

FIG. 6 shows the electrical control mechanism of the valve 14, which is a simple linear control mechanism. The liquid level in the recirculator 15 is measured by a capacitance level transmitter 69, which is connected to a level transducer 70 that produces output signals. The recirculator 15 operates between 10% (minimum) and 20% (maximum) feed level. The transducer 70 produces a 4–20 ma signal output to a controller 71. When the liquid level in the recirculator 15 is at a level of 10%, the transducer 70 produces a 5.6 ma output signal to the controller 71, which transforms it to a 10 v dc voltage signal, which is sent through wires 68 to the motor 72 that turns the shaft 63 causing the rocker arm 61 to move downwardly to position 61 A causing the slide tube 38 to fully expose the passageways 37 to liquid refrigerant flow.

At 20% liquid level in the recirculator 15, the transducer 70 produces an output signal of 7.2 ma, which is sent to the controller 71 that transforms it to voltage output of 2 v dc, which is sent to the motor that turns the shaft 63 causing the rocker arm 61 to move upwardly from its position 61A causing the slide tube 38 to fully close the passageway 37 blocking any liquid flow. The relationship between the system limits is linear and inversely proportional. For example, 7.2 ma produces a 2 v dc voltage, 6.4 ma produces a 6 v dc voltage and 5.6 ma produces a 10 v dc voltage.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed as new and what it is desired to secure by Letters Patent of the United States is:

1. A valve for use in a refrigeration system, said valve comprising an elongated housing having a longitudinal axis extending generally vertically, said housing having an inlet extending generally perpendicular to said axis for receiving heated liquid refrigerant having traces of entrained vapor bubbles and an outlet for discharging liquid refrigerant and gas refrigerant through an outlet directed generally in the same direction as said axis, said valve housing including an upright outer shell having outside and inside surfaces, an elongated upright inner hollow tubular member positioned inside said outer shell with its longitudinal axis coincident with said axis of said housing, said tubular member having an outer and inner surface and proximal and distal ends, said inside surface of said outer shell and said outer surface of said tubular member forming a vapor bubbles condensation chamber, said tubular member having a plurality of vertically spaced passageways extending generally perpendicular to said axis and through said inner and outer surfaces of said tubular member, and a slide tube outwardly of said tubular member for selectively closing and opening one or more of said passageways to minimize vapor bubbles passage therethrough while permitting pressurized liquid and gas refrigerant to pass therethrough in response to system load and discharge through said outlet.

2. The valve of claim 1 wherein said outer shell comprises an upper portion and a lower portion, said lower portion having top and bottom end sections, said inlet generally being located medially between said end sections, said upper portion having top and bottom end sections, said top end section being a portion of said vapor bubbles condensation chamber.

3. The valve of claim 1 wherein said vapor bubbles condensation chamber includes a collar mounted on said distal end of said tubular member and being affixed to and adjacent said inside surface of said outer shell.

4. The valve of claim 1 wherein said tubular member has a long axis substantially coincident with said longitudinal axis, said outlet of said housing being spaced above an outlet of said tubular member and fluidly communicating with each other.

5. The valve of claim 1 further including a movable flow controller means for moving said slide tube.

6. The valve of claim 5 wherein said controller means includes an actuator positioned beneath and to said slide tube for moving said slide tube between open and closed positions, said open position exposing one or more of said passageways of said tubular member to permit pressurized liquid to pass therethrough in response to the system load and through said outlet, said closed position blocking flow through said tubular member.

7. The valve of claim 1 wherein said valve is positioned between a receiver of a condenser and a recirculator of an evaporator in a refrigeration system.

8. The valve of claim 1 wherein said tubular member includes a seal located spacedly above all of said passageway, said slide tube having an upper end portion which completely closes against said seal to maintain said pressurized liquid and vapor refrigerant maintained within said valve housing.

9. The valve of claim 1 wherein said slide tube has distal and proximal ends, a lip seal attached to and located adjacent said distal end of said slide tube for sealingly engaging said outer surface of said tubular member during sliding movement of said slide tube in closing and opening one or more of said passageways.

10. The valve of claim 1 further including a ring disk for sealing between said slide tube and said outer surface of said tubular member.

11. A flow control valve comprising an elongated housing having a longitudinal axis extending generally vertically, said housing having an inlet extending generally perpendicular to said axis for receiving a liquid feed having vapor bubbles and an outlet for discharging pressurized liquid and gas refrigerant through an outlet directed generally in the same direction as said axis, said valve housing having an upright outer shell with its longitudinal axis coincident with said axis of said housing, a tubular member having an outer and inner surface and proximal and distal ends, said inside surface of said outer shell and said outer surface of said tubular member forming a vapor bubbles condensation chamber, said tubular member having a plurality of vertically spaced passageways extending generally perpendicular to said axis and through said inner and outer surfaces of said tubular member, and being located below the bubbles condensation chamber, and a slide tube outwardly of said tubular member for selectively closing and opening one or more of said passageways to modulate the flow of refrigerant in response to system load while permitting liquid feed to pass therethrough and discharge through said outlet, a movable flow controller means for moving said slide tube, said controller means including an actuator positioned beneath and connected to said slide tube for moving said slide tube between open and closed positions, said open position exposing one or more of said passageways of said tubular member to permit pressurized liquid and gas refrigerant to pass therethrough and through said outlet, said closed position blocking flow through said tubular member.

12. The valve of claim 11 wherein said outer shell comprises an upper portion and a lower portion, said lower portion having top and bottom end sections, said inlet generally being located medially between said end sections, said upper portion having top and bottom end sections, said top end section being a portion of said vapor bubbles condensation chamber.

13. The valve of claim 11 wherein said vapor bubbles condensation chamber includes a collar having an upper end mounted on said distal end of said tubular member and being affixed to and adjacent said inside surface of said outer shell, a lower end of said collar and said distal end of said tubular member being spaced inwardly from said inside surface of said outer shell so that bubbles may collect therebetween said chamber being spaced above all of said passageways.

14. The valve of claim 11 wherein said tubular member has a long axis substantially coincident with said longitudinal axis, said outlet of said housing being spaced above an outlet of said tubular member and fluidly communicating with each other.

15. The valve of claim 11 further including a ring disk for sealing between said slide tube and said outer surface of said tubular member.

16. The valve of claim 15 wherein said tubular member includes a ring seal located spacedly above all of said passageways, said ring disk sealing off all of said passageways prior to shut off of said valve, said slide tube having an upper end portion which completely closes against said ring seal to maintain said pressurized liquid and vapor refrigerant maintained within said valve housing.

17. The valve of claim 11 wherein said vapor bubbles condensation chamber includes a collar having an upper end mounted on said distal end of said tubular member and being affixed to and adjacent said inside surface of said outer shell, a lower end of said collar and said distal end of said tubular member being spaced inwardly from said inside surface of said outer shell so that bubbles may collect therebetween.

18. The valve of claim 17 wherein said outer shell comprises an upper portion and a lower portion, said lower portion having top and bottom end sections, said inlet generally being located medially between said end sections, said upper portion having top and bottom end sections, said top end section being a portion of said vapor bubbles condensation chamber.

19. The valve of claim 17 wherein said tubular member includes a ring seal located spacedly above all of said passageways, said slide tube having an upper end portion which completely closes against said ring seal to maintain said pressurized liquid and vapor refrigerant maintained within said valve housing.

20. The valve of claim 17 wherein said slide tube has distal and proximal ends, comprising a lip seal attached to and located adjacent said distal end of said slide tube for sealingly engaging said outer surface of said tubular member during sliding movement of said slide tube in closing and opening one or more of said passageways.

21. The valve of claim 17 wherein said tubular member has a long axis substantially coincident with said longitudinal axis, said outlet of said housing being spaced above an outlet of said tubular member and fluidly communicating with each other.

22. The valve of claim 17 further including a ring disk for sealing between said slide tube and said outer surface of said tubular member.

23. The system of claim 11 wherein said passageways are located in a diametrically opposed pattern to reduce impingement erosion of said inner surface of said tubular member.

24. In a refrigeration system including a compressor for receiving low-pressure gas refrigerant and compressing it to a high-pressure refrigerant, a condenser for receiving a high-pressure refrigerant and converting a portion of it to a liquid refrigerant having entrained vapor bubbles, a drum receiver for receiving liquid refrigerant and separating gas portion from liquid portion, a recirculator for receiving liquid refrigerant substantially free of vapor bubbles and gas refrigerant and separating gas from liquid refrigerant and vaporizing it and sending it to said compressor, and circulating liquid refrigerant to said recirculator, the improvement comprising a vertically oriented control valve for receiving liquid refrigerant having entrained bubbles and for substantially eliminating vapor bubbles, said valve being coupled between said drum receiver and said recirculator.

25. The system of claim 24 wherein said valve includes an elongated housing having a longitudinal axis extending generally vertically, said housing having an inlet extending generally perpendicular to said axis for receiving a pressurized heated liquid refrigerant having traces of entrained vapor bubbles and an outlet for discharging liquid refrigerant and gas refrigerant substantially free of vapor bubbles through an outlet directed generally in the same direction as said axis, said valve housing including an upright outer shell having outside and inside surfaces, an elongated upright inner hollow tubular member positioned inside said outer shell with its longitudinal axis coincident with said axis of said housing, said tubular member having an outer and inner surface and proximal and distal ends, said inside surface of said outer shell and said outer surface of said tubular member forming a vapor bubbles condensation chamber, said tubular member having a plurality of vertically spaced passageways extending generally perpendicular to said axis and through said inner and outer surfaces of said tubular member, and a slide tube outwardly of said tubular member for selectively closing and opening one or more of said passageways to inhibit vapor bubbles from passing therethrough while permitting pressurized liquid and vapor refrigerant to pass therethrough and discharge through said outlet.

26. The system of claim 25 wherein said outer shell includes an upper portion and a lower portion, said lower portion having top and bottom end sections, said inlet generally being located medially between said end sections, said upper portion having top and bottom end sections, said top end section being a portion of said vapor bubbles condensation chamber.

27. The system of claim 25 wherein said vapor bubbles condensation chamber which includes a collar mounted on said distal end of said tubular member and being affixed to and adjacent said inside surface of said outer shell.

28. The system of claim 25 wherein said tubular member has a long axis substantially coincident with said longitudinal axis, said outlet of said housing being spaced above an outlet of said tubular member and fluidly communicating with each other.

29. The system of claim 25 further including a movable flow controller means for moving said slide tube.

30. The system of claim 29 wherein said controller means includes an actuator positioned beneath and to said slide tube for moving said slide tube between open and closed positions, said open position exposing one or more of said passageways of said tubular member to permit pressurized liquid and vapor to pass therethrough and through said outlet, said closed position blocking flow through said tubular member.

31. The system of claim 25 wherein said tubular member includes a ring seal located spacedly above all of said passageway, said slide tube having an upper end portion which completely closes against said ring seal to maintain said pressurized liquid and vapor refrigerant maintained within said valve housing, said slide tube having distal and proximal ends, a lip seal attached to and located adjacent said distal end of said slide tube for sealingly engaging said outer surface of said tubular member during sliding movement of said slide tube in closing and opening one or more of said passageways, a ring disk for sealing between said slide tube and said outer surface of said tubular member.

32. The system of claim 25 wherein said passageways are located in a diametrically opposed pattern to reduce impingement erosion of said inner surface of said tubular member.

* * * * *